US006035099A

United States Patent [19]

Stern

[11] Patent Number: 6,035,099

[45] **Date of Patent: *Mar. 7, 2000**

[54] APPARATUS HAVING HEATING CHAMBER ENCLOSURE WITH HEIGHT-ADJUSTABLE HAIR SETTING ROLLER HOLDER MEMBERS

[75] Inventor: Paule Stern, San Diego, Calif.

[73] Assignee: Madison Star, LLC, San Diego, Calif.

[ * ] Notice: This patent is subject to a terminal disclaimer.

[21] Appl. No.: 08/990,864

[22] Filed: Dec. 15, 1997

Related U.S. Application Data

[63] Continuation-in-part of application No. 08/536,936, Sep. 29, 1995, Pat. No. 5,710,861.

[51] Int. Cl.[7] ..... A61H 33/12; A45B 1/04

[52] U.S. Cl. ..... 392/405; 219/222

[58] Field of Search ..... 392/324, 404, 392/405, 406, 444, 445; 219/221, 222; 132/227, 228, 229, 230, 269, 271

[56] References Cited

U.S. PATENT DOCUMENTS

| | | | |
|---|---|---|---|
| 3,128,882 | 4/1964 | Kardulas | 211/13 |
| 3,493,722 | 2/1970 | Popeil | 219/222 |
| 3,600,552 | 8/1971 | Tolmie et al. | 219/222 |
| 3,610,878 | 10/1971 | Thomas et al. | 219/222 |
| 3,618,750 | 11/1971 | Reiner | 206/743 |
| 3,646,316 | 2/1972 | Volosin et al. | 219/222 |
| 3,666,915 | 5/1972 | De Napoli | 219/222 |
| 3,700,853 | 10/1972 | Jensen et al. | 219/222 |
| 3,858,029 | 12/1974 | Walter | 219/222 |
| 4,572,221 | 2/1986 | Barradas | 132/33 R |
| 4,603,706 | 8/1986 | Caruso | 132/41 |
| 4,627,452 | 12/1986 | Caruso | 132/33 R |
| 5,255,694 | 10/1993 | Caruso | 132/228 |
| 5,482,060 | 1/1996 | Barradas | 132/226 |
| 5,710,861 | 1/1998 | Stern | 392/405 |

*Primary Examiner*—Sang Paik

*Attorney, Agent, or Firm*—Flanagan & Flanagan; John R. Flanagan; John K. Flanagan

[57] ABSTRACT

A multiple hair setting roller heating apparatus includes a housing having a heating chamber defined therein, a heat generating source disposed in the housing, and a plurality of height-adjustable elongated holder members in the form of hollow posts supported upright in the heating chamber of the housing. The height-adjustable holder members are adjustably movable between lowered and raised positions for holding different numbers and sizes of hair setting rollers at different elevations to thereby selectively change the roller holding capacity of the heating chamber. The housing includes an enclosure, a top cover removably fitted on an open top of the enclosure for enclosing the heating chamber of the housing, and a flat platform disposed in the housing enclosure and supporting the height-adjustable holder members in the heating chamber. The enclosure also is adapted to hold a quantity of fluid, such as water, in communication with the heating chamber. When the heat generating source is activated, the fluid is transformed into a vapor, such as water to steam, which enters the heating chamber and the holder members to heat the hair setting rollers supported in the heating chamber on the holder members.

23 Claims, 10 Drawing Sheets

APPARATUS HAVING HEATING CHAMBER ENCLOSURE WITH HEIGHT-ADJUSTABLE HAIR SETTING ROLLER HOLDER MEMBERS

This is a continuation-in-part of copending patent application Ser. No. 08/536,936, filed Sep. 29, 1995, now U.S. Pat. No. 5,710,861.

BACKGROUND OF THE INVENTION

1. Field of the Invention

The present invention generally relates to hair styling apparatus and, more particularly, is concerned with an apparatus having height-adjustable hair setting roller holder members in a heating chamber enclosure of the apparatus for holding different numbers and sizes of hair setting rollers at different elevations to thereby selectively change the roller holding capacity of the heating chamber.

2. Description of the Prior Art

Hair setting rollers are used to form waves and/or curls in a person's hair. Preferably, the person's hair is dry or nearly dry and the hair setting rollers are heated prior to placement in the person's hair. Often, a combination of both larger and smaller hair setting rollers are employed to achieve a hair style ranging from loose waves to tight curls. It is desirable to heat each of the hair setting rollers simultaneously and evenly. Depending on the person's hair and the hair style desired, sometimes it is preferable to be able heat different numbers and sizes of the hair setting rollers.

Devices exist that are designed to heat a plurality of hair setting rollers at the same time. Representative examples of such devices are disclosed in U.S. Pat. No. 3,610,878 to Thomas et al, U.S. Pat. No. 3,646,316 to Volosin et al, U.S. Pat. No. 3,858,029 to Walter, U.S. Pat. Nos. 4,572,221 and 5,482,060 to Barradas and U.S. Pat. Nos. 4,603,706, 4,627, 452 and 5,255,694 to Caruso. Many of these patents disclose devices having a housing, a plurality of roller holder posts within the housing and heating means provided either below or inside the posts for heating to desired temperatures the hair setting rollers placed over the posts. While the devices disclosed in these prior art patents may heat hair setting rollers satisfactorily, a common drawback of these devices is that they lack the versatility of being able to hold and heat different numbers and sizes of hair setting rollers at different elevations.

Consequently, a need still exists for an apparatus that has the capability of heating different numbers and sizes of hair setting rollers at different elevations.

SUMMARY OF THE INVENTION

The present invention provides a multiple hair setting roller heating apparatus designed to satisfy the aforementioned needs by avoiding the drawbacks of the prior art without introducing other drawbacks. The roller heating apparatus of the present invention is adapted for holding and heating different numbers and sizes of hair setting rollers at different elevations in a heating chamber enclosure with telescopic sets of hair setting roller holder members for changing the holding capacity of the heating chamber between maximum and minimum quantities of rollers.

Accordingly, the present invention is directed to an apparatus for heating multiple hair setting rollers. The apparatus comprises: (a) a housing having a heating chamber defined therein; (b) a plurality of height-adjustable elongated holder members supported upright in the heating chamber of the housing, the holder members being adjustably movable relative to one another between lowered and raised positions for holding different numbers and sizes of hair setting rollers at different elevations in the heating chamber to thereby facilitate changing the roller holding capacity of the heating chamber; and (c) means disposed in the housing for generating heat to raise the temperature of the hair setting rollers supported in the heating chamber on the holder members.

More particularly, the height-adjustable roller holder members include a first plurality of elongated support rods disposed generally upright in the heating chamber and being adapted to receive a first group of hair setting rollers thereover and a second plurality of support rods being slidably fitted telescopically with the first rods and thereby mounted to undergo telescopic sliding movement between the lowered and raised positions relative to the first rods. The second rods also being adapted to receive a second group of hair setting rollers thereover. In a first form, the second rods are smaller in diameter than the first rods such that the second rods telescopically insert into the first rods through upper open ends thereof. In a second form, the first rods are smaller in diameter than the second rods such that the first rods telescopically insert into the second rods through lower open ends thereof.

Still further, the housing includes an enclosure having an open top and a top cover removably fitted on the open top of the enclosure for enclosing the heating chamber and rollers supported on the holder members in the heating chamber. The housing also includes a platform disposed in the enclosure and supporting the height-adjustable telescopic holder members in the heating chamber.

Additionally, the enclosure is adapted to hold a quantity of a liquid, such as water, in communication with the heating chamber. The heating means disposed in the housing is adapted to generate heat that transforms the fluid into a vapor, such as water into steam, which enters the heating chamber and the holder members of the sets thereof to heat the hair setting rollers supported in the heating chamber on the holder members.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
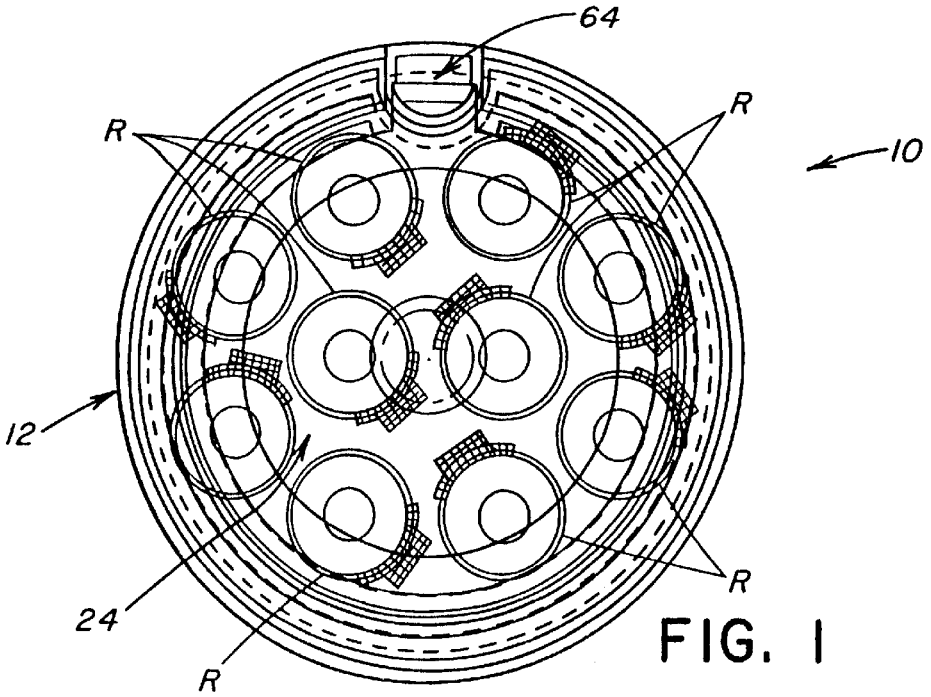
FIG. 1 is a top plan view of a first embodiment of a multiple hair setting roller heating apparatus comprising the invention of the application cross-referenced above.
Figure 2:
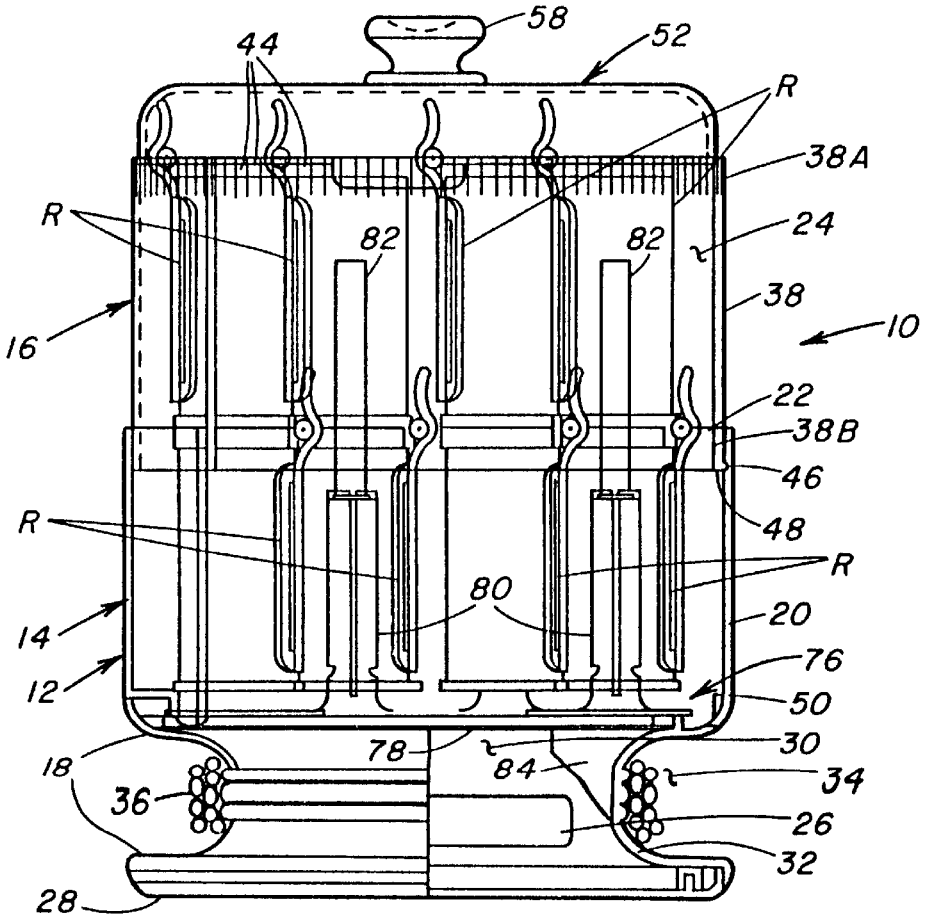
FIG. 2 is a side elevational view of the roller heating apparatus of FIG. 1 with its enclosure in an extended condition.
Figure 3:
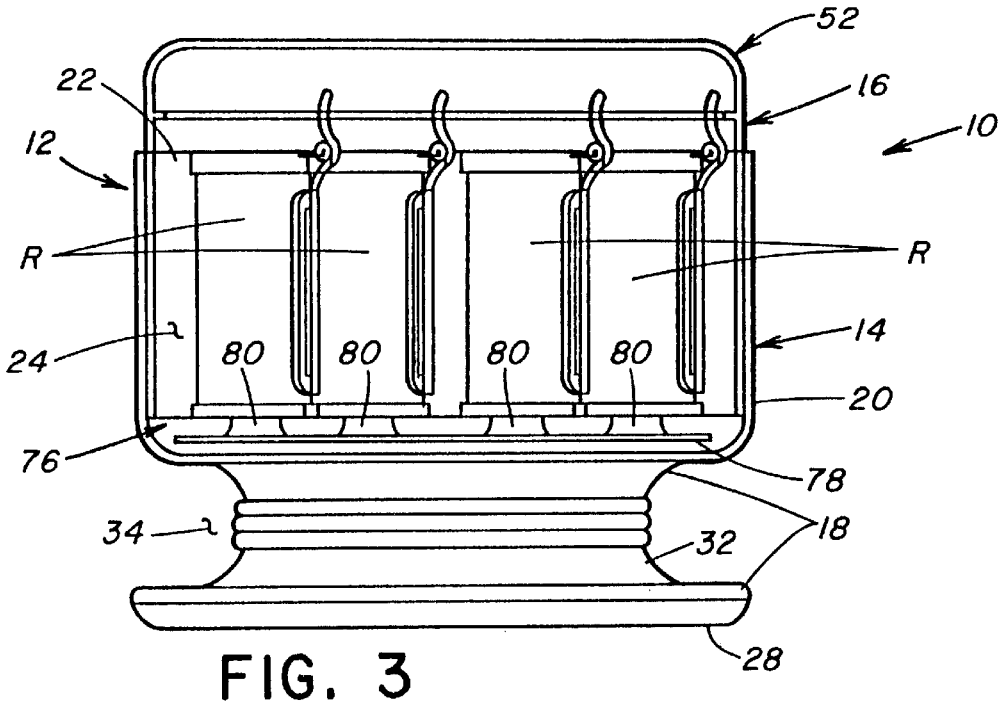
FIG. 3 is a side elevational view of the roller heating apparatus of FIG. 1 with its enclosure in a contracted condition.
Figure 4:
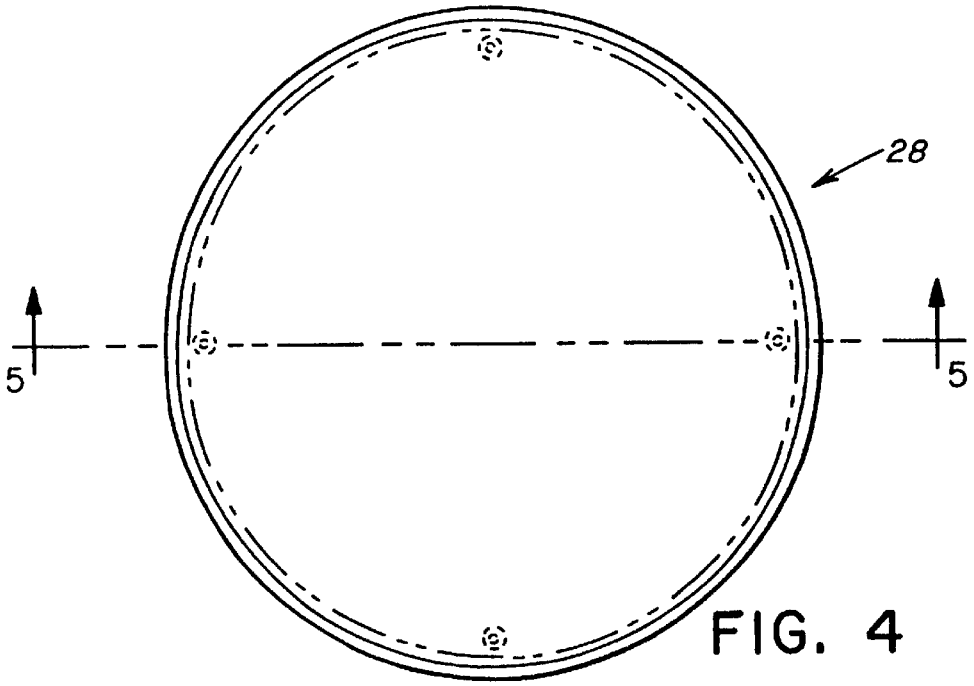
FIG. 4 is top plan view of a bottom cover of a lower base of the enclosure of the roller heating apparatus of FIG. 1.
Figure 5:
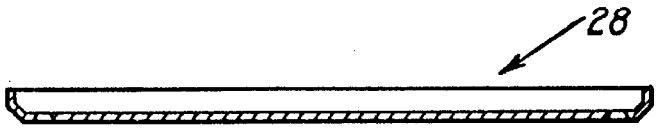
FIG. 5 is a vertical cross-sectional view of the bottom cover of the enclosure taken along line 5—5 in FIG. 4.

Referring to the drawings, and particularly to FIGS. 1 to 3, there is illustrated a first embodiment of a multiple hair setting roller heating apparatus, generally designated 10, which comprises the invention of the application cross-referenced above. The roller heating apparatus 10 is constructed for heating a plurality of hair setting rollers R for use in curling hair.

Basically, the roller heating apparatus 10 includes a telescopic enclosure 12. The telescopic enclosure 12 includes a lower housing body 14 and an upper housing extension 16. The lower housing body 14, in turn, includes a lower base 18 for receiving and holding a quantity of water therein and an upper annular sidewall that is attached to and extends upward from the lower base 18. The upper annular sidewall 20 defines an open upper end 22 of the lower housing body 14. The upper housing extension 16 is mounted through the open upper end 22 and within the upper sidewall 20 of the lower housing body 14. The upper housing extension 16 is mounted within the lower housing body 14 such that it may undergo sliding telescopic movement along the upper sidewall 20 of the lower housing body 14 respectively toward and away from the lower base 18 thereof. The upper housing extension 16 is movable relative to the lower housing body 14 between an upper extended condition, as shown in FIG. 2, wherein the upper housing extension 16 is displaced away from the lower base 18 of the lower housing body 14 and a lower contracted condition, as shown in FIG. 3, wherein the upper housing extension 16 is disposed adjacent to the lower base 18 of the lower housing body 14.

Defined within the telescopic enclosure 12 by the lower housing body 14 and the upper housing extension 16 is a heating chamber 24. When the upper housing extension 16 is in the extended condition relative to the lower housing body 14, the heating chamber 24 has a first volume for containing a first plurality of the hair setting rollers R. On the other hand, when the upper housing extension 12 is in the contracted condition relative to the lower housing body 14, the heating chamber 24 then has a second volume that is smaller than the first volume for containing a second plurality of the hair setting rollers R which are smaller in number than the first plurality of hair setting rollers R. Disposed within the lower base 18 of the lower housing body 14 are means, such as a heating element 26, for generating heat in the heating chamber 24 of the telescopic enclosure 12. The heating element 26 per se can be a conventional electric unit well-known to those of ordinary skill in the art.

Referring now to FIGS. 2 through 7, the lower housing body 14 of the telescopic enclosure 12 includes the integrally connected lower base 18 and upper sidewall 20 and a bottom cover 28 underlying and connected to the lower base 18. These parts of the lower housing body 14 together define a receptacle 30 for receiving and holding a quantity of water therein. The lower base 18 preferably includes a lower annular sidewall 32 that is attached at an upper end to a lower end of the upper annular sidewall 20 of the lower housing body 14. The lower annular sidewall 32 has a diameter less than the diameter of the upper annular sidewall 20 so as to define an annular recessed region 34 surrounding the lower annular sidewall 32 and underlying the upper annular sidewall 20. An electrical cord 36 may be stored in the annular recessed region 34 in a wrapped relation about the lower annular sidewall 32. The electrical cord 34 extends through the lower base 18 to connect with the electric heating element 26 disposed in the lower base 18. As mentioned earlier, the lower base 18 also preferably includes a removable bottom cover 28. The bottom cover 28 is removably attached to a bottom edge portion of the lower annular sidewall 32 of the lower base 18 thereby affording access to the heating element 26 disposed within the interior of the lower base 18.

Referring now to FIGS. 2, 3 and 8 through 14, the upper housing extension 16 of the telescopic enclosure 12 is preferably an annular sleeve 38 of cylindrical shape concentric with the cylindrical shape of the upper sidewall 20 of the lower housing body 14. The annular sleeve 38 is slightly smaller in diameter than the upper sidewall 20 of the lower housing body 14. The sleeve 38 has axially spaced opposite top and bottom ends 38A, 38B which are open such that the top end 38A of the sleeve 38 defines an open top of the heating chamber 24 of the telescopic enclosure 12 for placing the rollers R into the heating chamber 24 and removing the rollers R from the heating chamber 24.

Figure 8:
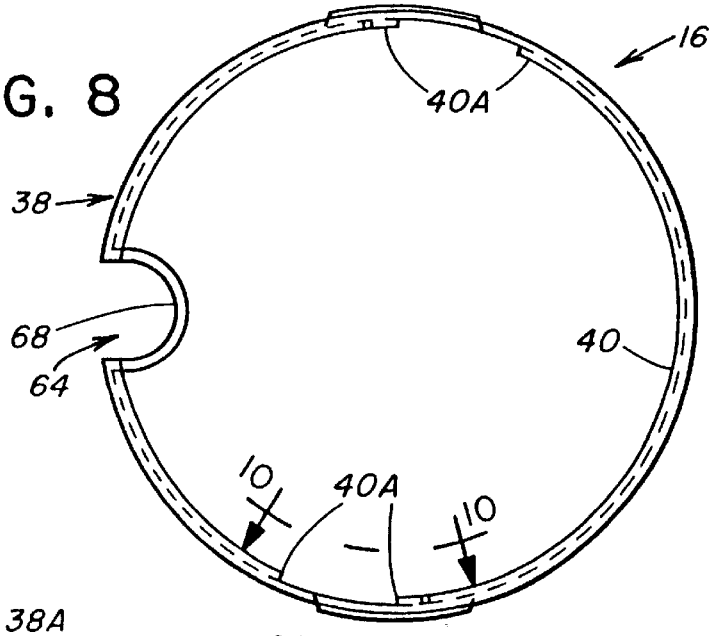
FIG. 8 is a top plan view of an upper housing extension of the enclosure of the roller heating apparatus of FIG. 1.
Figure 10:
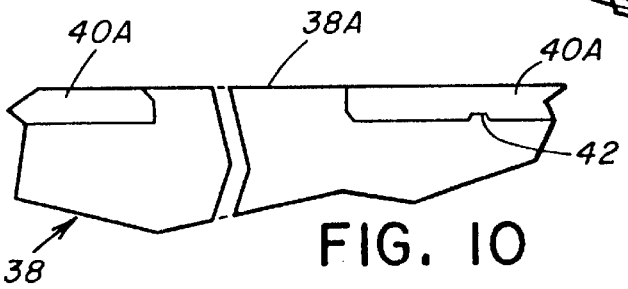
FIG. 10 is an enlarged fragmentary detailed view of an upper end of the upper housing extension of the enclosure taken along line 10—10 in FIG. 8.
Figure 12:
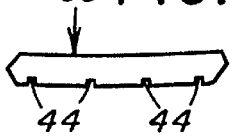
FIG. 12 is a top plan view of the upper end of the upper housing extension taken along line 12—12 in FIG.
Figure 11:
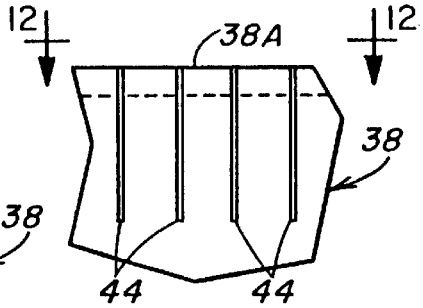
FIG. 11 is an enlarged fragmentarly side elevational view of an upper end of the upper housing extension taken at circle 11 in FIG. 9.

Referring to FIGS. 8 and 10, the sleeve 38 has a pair of arcuate shoulders 40 formed on and projecting radially inwardly from the interior surface of the top end 38A of the sleeve 38. The shoulders 40 terminate at opposite ends 40A which are angularly spaced from one another on the opposite sides of the sleeve 38. A small depression 42 is formed on the underside of each shoulder end 40A. A plurality of vertical grooves 44 are formed in the exterior surface of the sleeve 38. The vertical grooves 44 extend a short distance downward parallel to the longitudinal axis of the sleeve 38 from the top end 38A of the sleeve 38 and assist the user in gripping of the top end 38A of the sleeve 38 when sliding the upper housing extension 16 from its contracted to extended condition.

Figure 7:
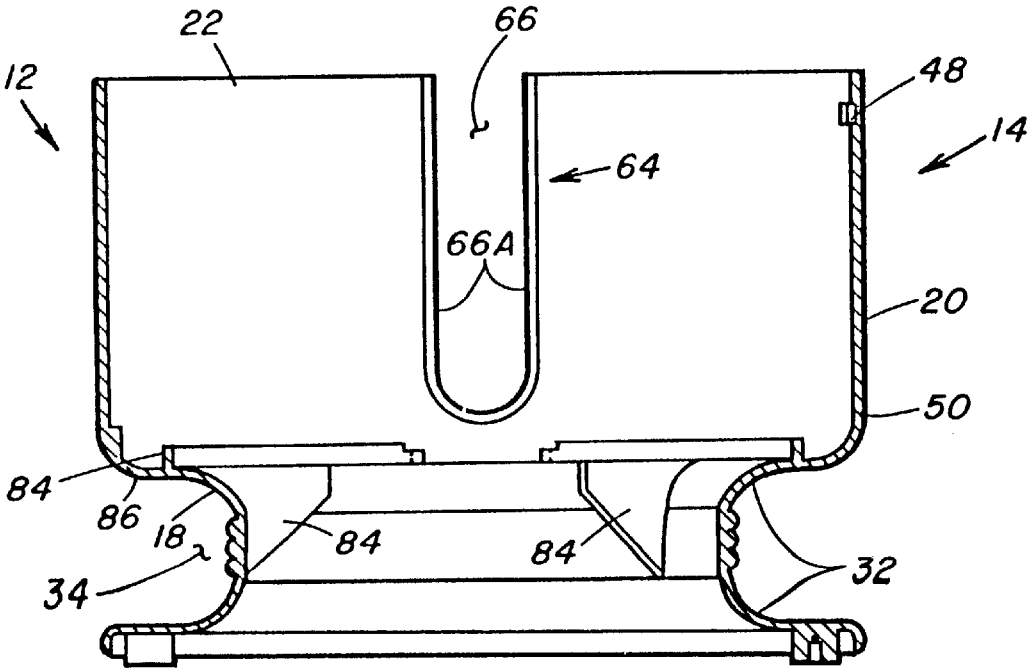
FIG. 7 is a vertical cross-sectional view of the lower housing body of the enclosure taken along line 7—7 in FIG. 6.
Figure 14:
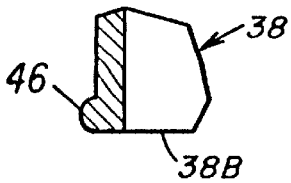
FIG. 14 is an enlarged fragmentary vertical cross-sectional view of a bottom end of the upper housing extension taken along line 14—14 in FIG. 9.

Referring to FIGS. 2 and 14, the upper housing extension 16 also includes a first protruding detent element 46 formed on the exterior of and adjacent to the bottom end 38B of the cylindrical sleeve 38. Referring also to FIGS. 2 and 7, the lower housing body 14 also includes upper and lower second recessed detent elements 48, 50 formed on the interior of and adjacent to the respective upper and lower ends of the upper sidewall 20 of the lower housing body 14. The first protruding detent element 46 is shaped complementary to and thus is matable with the upper second recessed detent element 48 when the upper housing extension 16 is in its extended condition. When the upper housing extension 16 is then moved to its contracted condition, the first protruding detent element 46 is mateable with the lower second recessed detent element 50. The mating of the first protruding detent element 46 at separate instances with the respective upper and lower second recessed detent elements 48, 50 correspondingly releasably retains the upper housing extension 16 in the respective extended and contracted conditions of the telescopic enclosure 12.

Figure 17:
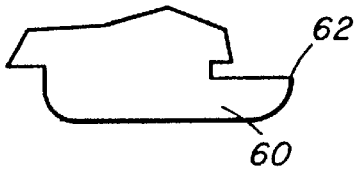
FIG. 17 is an enlarged fragmentary side elevational view of a hook element of the lid taken at ellipse 17 in FIG. 15.
Figure 16:
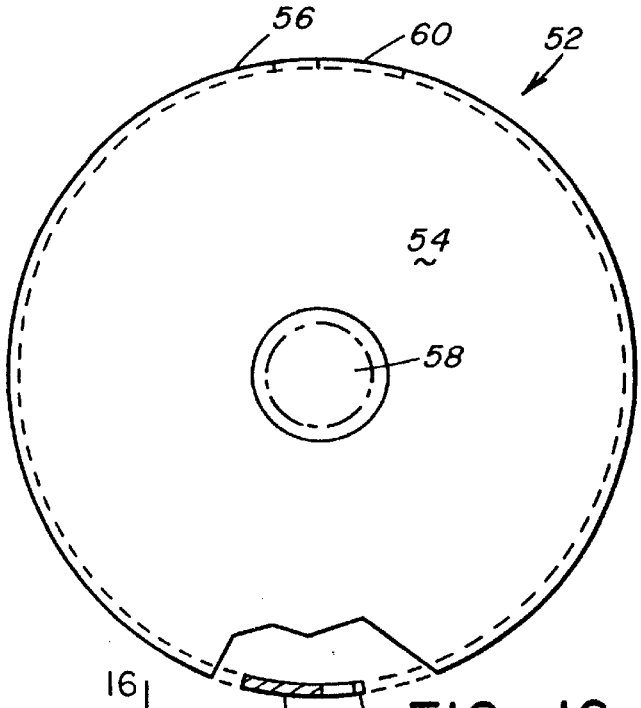
FIG. 16 is a top plan view of the lid taken along line 16—16 in FIG. 15.
Figure 15:
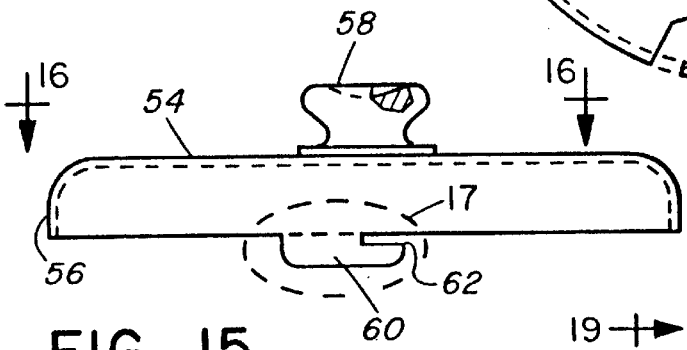
FIG. 15 is a side elevational view of a lid of the roller heating apparatus of FIG. 1.
Figure 18:
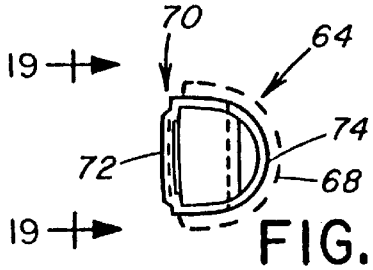
FIG. 18 is a top plan view of a water level viewing window structure of the roller heating apparatus of FIG. 1.
Figure 19:
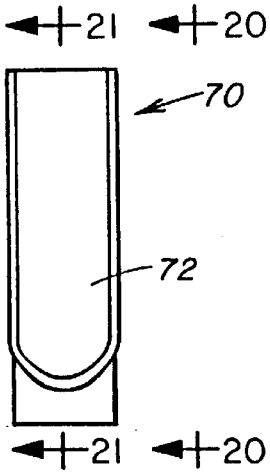
FIG. 19 is a front elevational view of the water level viewing window structure taken along line 19—19 in FIG. 18.
Figure 20:
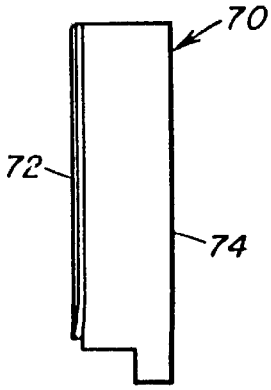
FIG. 20 is a side elevational view of the water level viewing window structure taken along line 20—20 in FIG. 19.
Figure 21:
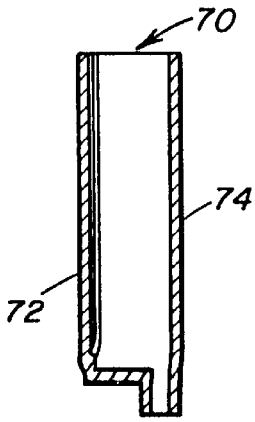
FIG. 21 is a vertical cross-sectional view of the water level viewing window structure taken along line 21—21 in FIG. 19.
Figure 25:
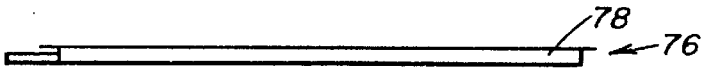
FIG. 25 is a vertical cross-sectional view of the annular bottom platform taken along line 25—25 in FIG. 24.
Figure 24:
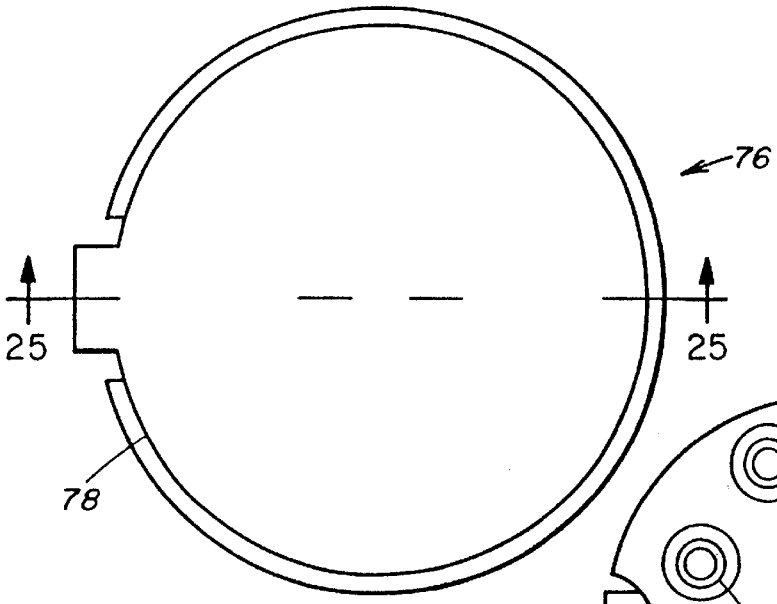
FIG. 24 is a top plan view of an annular bottom platform of the roller support assembly of FIG. 22.
Figure 22:
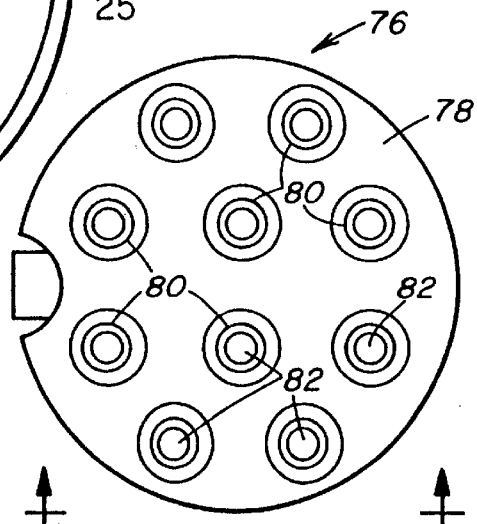
FIG. 22 is a top plan view, on a reduced scale, of a roller support assembly of the roller heating apparatus of FIG. 1.
Figure 26:
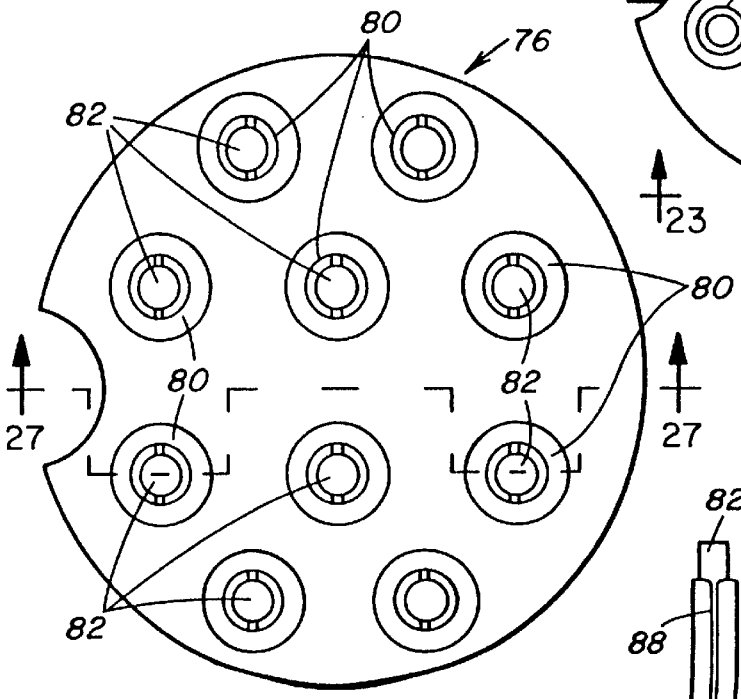
FIG. 26 is a top view of a plurality of heat transmission rods of the roller support assembly of FIG. 22.

Referring again to FIGS. 1 through 3, the roller heating apparatus 10 also includes a top cover or lid 52. The lid 52 removably fits on the open top of the upper housing extension 16 of the telescopic enclosure 12 to enclose the rollers R within the heating chamber 24 thereof. Referring now to FIGS. 15 through 17, the lid 52 has a generally flat top panel 54, a peripheral flange 56 attached to and surrounding the top panel 54 and extending downwardly therefrom, and a central knob 58 attached to the exterior top surface of the top panel 54. A pair of hook elements 60 are attached at and extend downwardly from opposite portions of the lower peripheral edge of the flange 56. The hook elements 60 are insertable through the spaces between the ends 40A of the shoulders 40 when the lid 52 is placed on the top end 38A of the annular sleeve 38 of the enclosure 12. Preferably, each hook element 60 includes a dimple 62 which interfits with the respective depression 42 in the shoulder 40 which it underlies to retain the lid 52 in a locked position on the sleeve 38. The lid 52 is rotatable between an unlocked position in which the hook elements 60 are angularly displaced from although are below the shoulders 40 and a locked position in which the hook elements 60 underlie the shoulders 40 thereby securing the lid 52 on the upper housing extension 16. Thus, the pairs of hook elements 60 and shoulder ends 40A combine with the shoulders 40 on the top end 38A of the sleeve 38 to form a releasable locking arrangement that detachably attaches the lid 52 on the open top of the upper housing extension 16.

Figure 6:
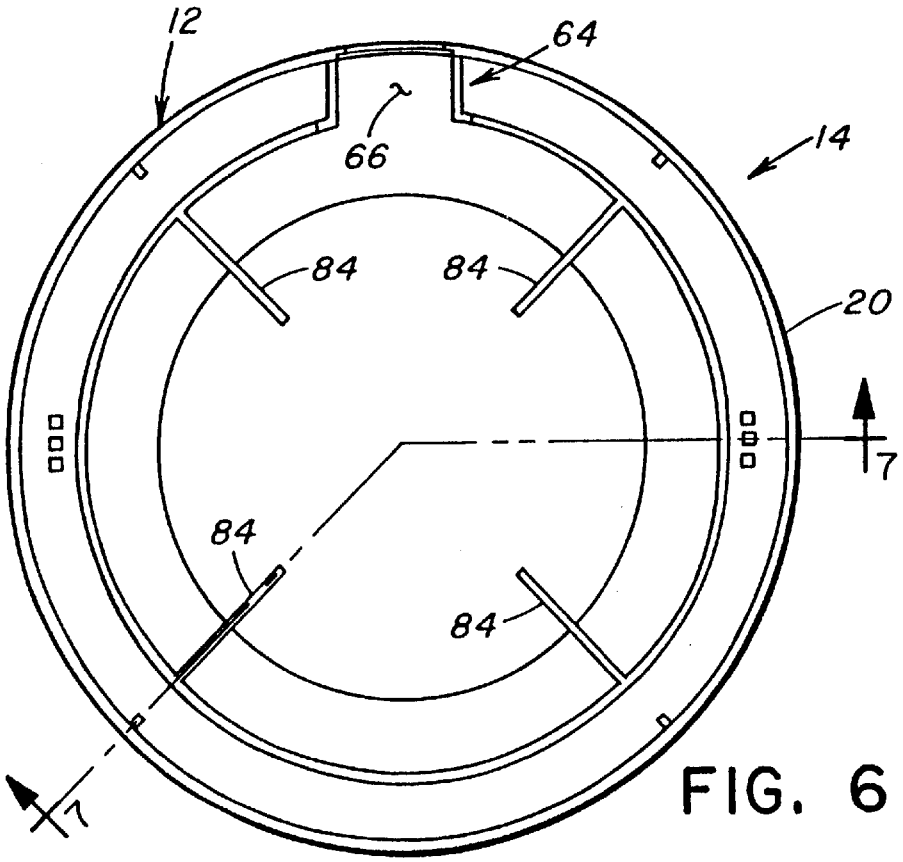
FIG. 6 is a top plan view of a lower housing body of the enclosure of the roller heating apparatus of FIG. 1.
Figure 9:
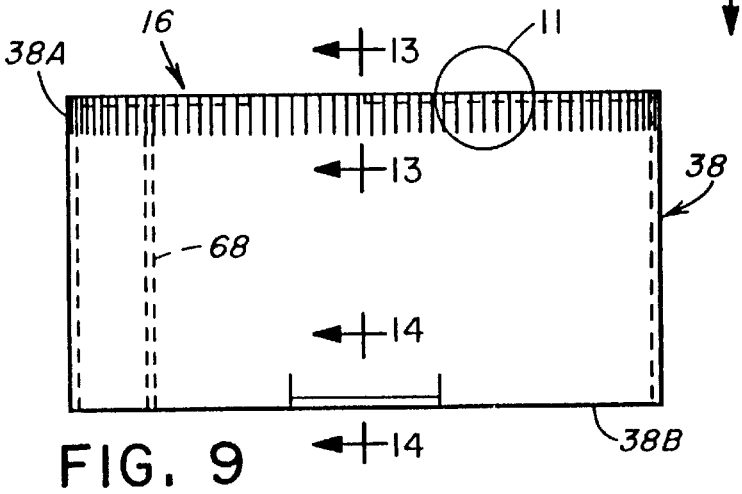
FIG. 9 is a side elevational view of the upper housing extension of the enclosure.
Figure 13:
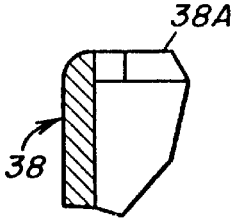
FIG. 13 is an enlarged fragmentary vertical cross-sectional view of the upper end of the upper housing extension taken along line 13—13 in FIG. 9.

Referring to FIGS. 1, 3, 7 to 9 and 18 to 21, the apparatus 10 also preferably includes a water level viewing window structure 64. The water level viewing window structure 64 is recessed in a longitudinal portion of the upper sidewall 20 of the lower housing body 14. The water level viewing window structure 64 includes a longitudinal slot 66 defined in a side portion of the upper sidewall 20 of the lower housing body 14 as best shown in FIGS. 6 and 7, a recessed wall portion 68 defined along a side of the upper housing extension 16 as best shown in FIGS. 8 and 9, and a tubular member 70 as best shown in FIGS. 18 through 21 that is mountable through the longitudinal slot 66 in the lower housing body 14 so that it extends into the heating chamber 24 of the enclosure 12.

Referring now to FIGS. 18 through 21, the tubular member 70 of the window structure 64 is open at its opposite top and bottom ends and includes an outer wall portion 72 of generally flat configuration adapted to slidably fit into and extend between opposite vertical edges 66A of the longitudinal slot 66, and an inner wall portion 74 of generally semi-cylindrical arcuate configuration connected along a pair of opposite longitudinal edges of the outer wall portion 72 and projecting into the heating chamber 24. The recessed wall portion 68 in the upper housing extension 16 has a generally arcuate configuration substantially conforming to that of the inner wall portion 74 of the tubular member 70 such that the recessed wall portion 68 of the upper housing extension 16 is concentric with and slidably telescopically moves along the inner wall portion 74 of the tubular member 70 as the upper housing extension 16 is so moved relative to the lower housing body 14 between the extended and contracted conditions of the telescopic enclosure 12. The concentric shape and telescopic movement of the recessed wall portion 68 of the upper housing extension 16 with the inner wall portion 74 of the tubular member 70 mounted to the lower housing body 14 also functions to guide and limit the upper housing extension 16 to such telescopic movement and prevent concurrent rotation of the upper housing extension 16 of the telescopic enclosure 12 relative to the lower housing body 14 thereof.

Referring now to FIGS. 22 through 31, the roller heating apparatus 10 also basically includes a roller support assembly 76 that support the rollers R within the heating chamber 24 of the telescopic enclosure 12. The roller support assembly 76 includes an annular bottom platform 78 that is disposed in the enclosure 12 between the lower base 18 and the upper sidewall 20 of the lower housing body 14, a first plurality of heat transmission rods 80 connected on and extending upright from the bottom platform 78, and a second plurality of heat transmission rods 82 insertable into and telescopically movable relative to the first rods 80. As shown in FIG. 7, the lower housing body 14 has a plurality of angularly spaced apart projections 84 formed therein on an annular flange portion 86 defined on the upper end of the lower sidewall 30 of the lower base 18 of the lower housing body 14 where it merges with the lower end of the upper sidewall 20 of the lower housing body 14. The spaced projections 84 underlie and support the roller support assembly 76 at the bottom platform 78 thereof across an open upper end of the lower base 18 and thus above the water contained within the lower base 18.

Figure 23:
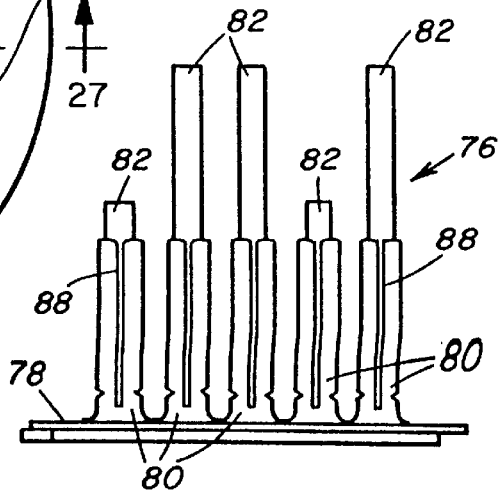
FIG. 23 is a side elevational view of the roller support assembly taken along line 23—23 in FIG. 22.
Figure 29:
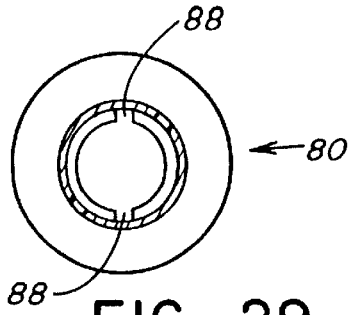
FIG. 29 is a horizontal cross-sectional view of the one first heat transmission rod taken along line 29—29 in FIG. 28.
Figure 31:
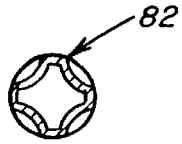
FIG. 31 is a horizontal cross-sectional view of the one second heat transmission rod taken along line 31—31 in FIG. 30.
Figure 28:
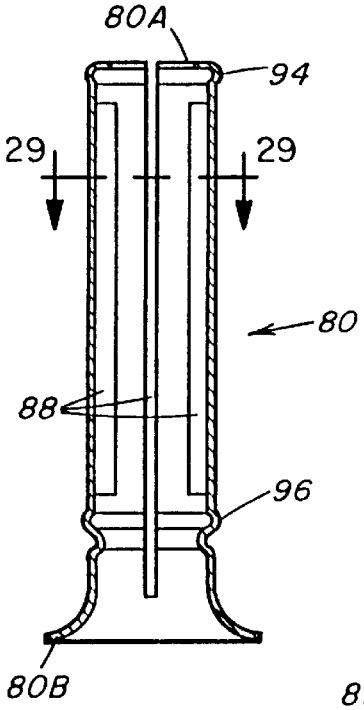
FIG. 28 is a vertical cross-sectional view of one of the first heat transmission rods of the roller support assembly of FIG. 22.
Figure 30:
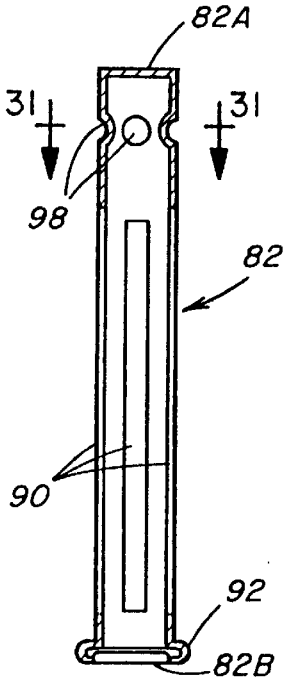
FIG. 30 is a vertical cross-sectional view of one of the second heat transmission rods of the roller support assembly of FIG. 22.
Figure 27:
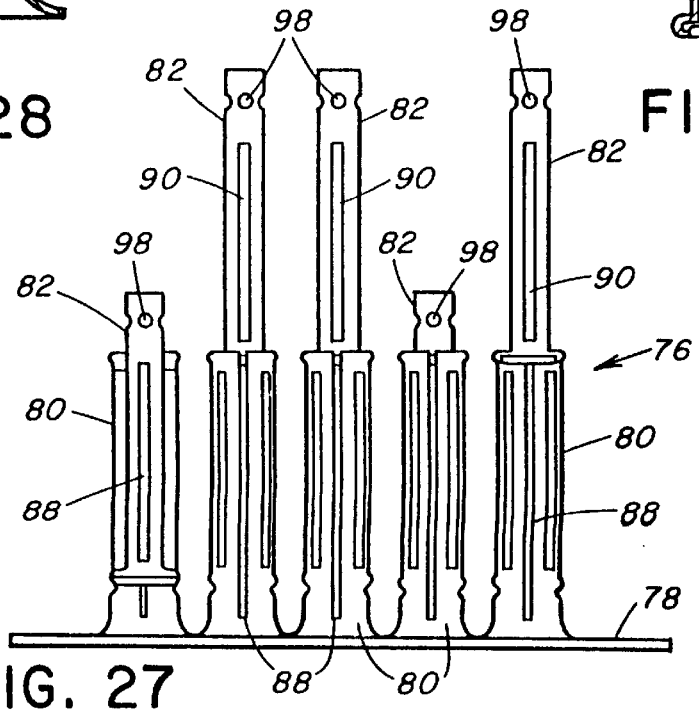
FIG. 27 is side cross-sectional view of the annular bottom platform and pluralities of first and second heat transmission rods of the roller support assembly taken along line 27—27 in FIG. 26.

The first and second rods 80, 82 are elongated hollow tubes. The first rods 80 have open upper and lower ends 80A, 80B, whereas the second rods 82 have a closed upper end 82B and an open bottom end. Both first and second rods 80, 82 also have respective longitudinal slots 88 and 90 defined therein extending between the opposite ends 80A, 80B and 82A, 82B. The second rods 82 are smaller in diameter than the first rods 80. The second rods 82 are telescopically inserted into the first rods 80 through the upper open ends 80A thereof and are mounted therein to undergo telescopic sliding movement between lowered and raised positions relative to the first rods 80, as best seen in FIGS. 23 and 27. The lower end 82B of each of the second rods 80 is deformably curled into an annular rim 92 which is matable with respective upper and lower annular recesses 94, 96 formed outwardly from the interiors of the first rods 80 at the opposite upper and lower ends 80A, 80B thereof when the second rod 82 is respectively disposed at the raised and lowered positions relative to the first rod 80. Indentations 98 formed in the sides of the second rods 82 near their top ends 82A assist the user in grasping of the second rods 82 when telescoping the second rods 82 upwardly from their lowered to raised positions. In order to dispose the upper housing extension 16 at the contracted condition relative to the lower housing body 14, the second rods 82 must first be retracted into the first rods 80 and thereby disposed at their lowered positions relative to the first rods 80. On the other hand, the upper housing extension 16 must first be disposed at the extended condition relative to the lower housing body 14 in order to extend the second rods 82 from the first rods 80 and thereby dispose the second rods 82 at their raised position relative to the first rods 80.

The above-described roller heating apparatus 10 of the present invention is utilized in the following manner to heat the hair setting rollers R. A first group of the hair setting rollers R are disposed over the first rods 80. If necessary, the upper housing extension 16 may be raised to the extended position and the second rods 82 moved to their raised positions relative to the first rods 80 so that a second group of the hair setting rollers R can be disposed over the second rods 82. Each of the rollers R in the second group thereof is disposed above and in an end-to-end relationship with one of the rollers R in the first group thereof, as seen in FIG 2. A quantity of water is be poured into the receptacle 30 formed by the lower housing body 14 before placing the hair setting rollers R over the rods 80, 82. The water level viewing window structure 64 allows the level of water to be viewed when pouring water into the receptacle 30 and during operation of the apparatus 10 to determine if the addition of more water is necessary. The heating element 26 is then activated to heat the heating chamber 24 and boil the water contained in the receptacle 30, thereby producing steam in the heating chamber 24. The steam rises from the receptacle 30 of the lower housing body 14 into the interior of the heat transmission rods 80, 82. The longitudinal slots 88 and opposite open upper and ends 80A, 80B of the first rods 80 and open lower ends of the second rods 82B permit passage of the steam therethrough to the hair setting rollers R disposed over the first and second rods 80, 82 thereby heating the rollers R.

Figure 32:
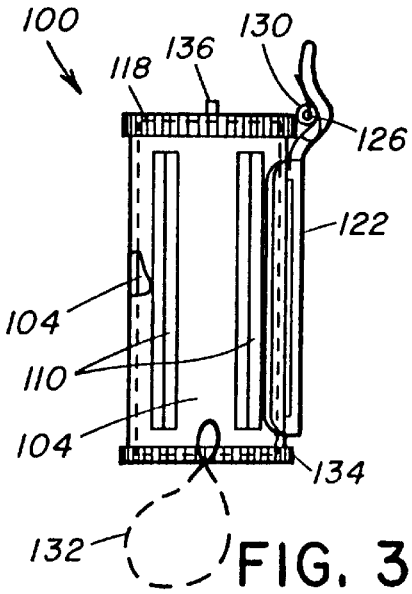
FIG. 32 is a side elevational view of a large diameter hair setting roller designed for use with the roller heating apparatuses of FIGS. 2 and 37, the roller being shown with its hair clip closed.
Figure 33:
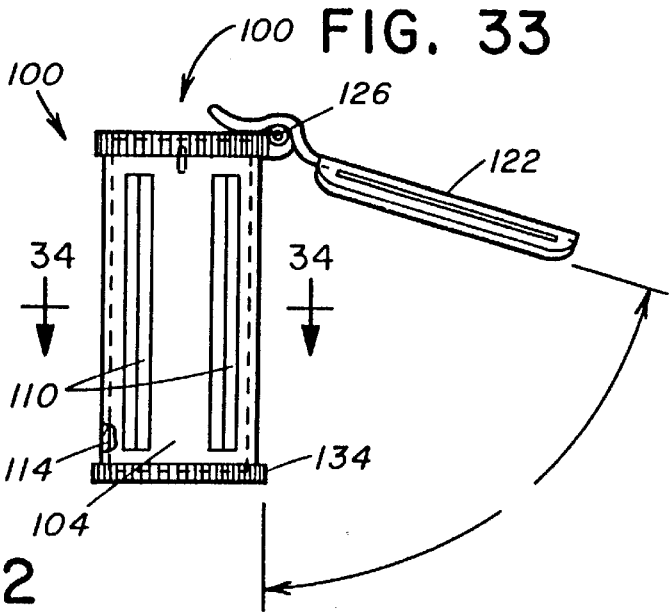
FIG. 33 is another side elevational view of the large diameter hair setting roller shown with its hair clip open.
Figure 35:
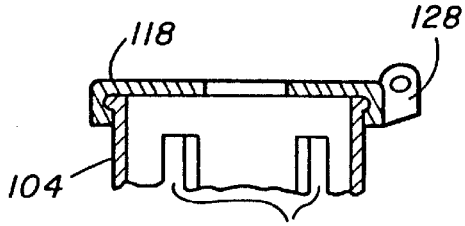
FIG. 35 is an enlarged fragmentary axial sectional view of the large diameter hair setting roller.
Figure 36:
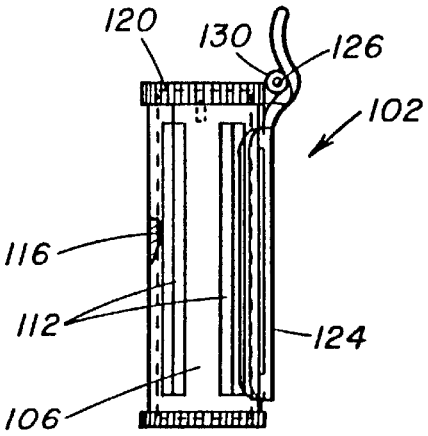
FIG. 36 is a side elevational view of a small diameter hair setting roller designed for use with the apparatuses of the FIGS. 2 and 37, the roller being shown with its hair clip closed.
Figure 34:
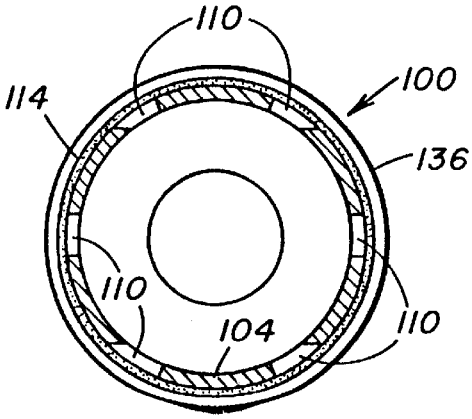
FIG. 34 is an enlarged transverse cross-sectional view of the large diameter hair setting roller taken along line 34—34 in FIG. 33.

The first embodiment of the roller heating apparatus described above and comprising the invention of the cross-referenced application and the second embodiment of the roller heating apparatus described hereafter comprising the present invention are well suited for heating rollers R configured as shown in FIGS. 32 through 36 as well as other rollers. The larger diameter hair setting roller 100 illustrated in FIGS. 32 to 34 is adapted for fitting over the larger diameter first rods 80. Likewise, the smaller diameter hair setting roller 102 illustrated in FIGS. 35 and 36 is adapted for fitting over the smaller diameter second rods 82 when they are at their raised positions relative to the first rods 80.

More particularly, both the larger and smaller rollers 100, 102 include respective cylindrical body members 104, 106 that define an inner steam chamber 108 and have a plurality of longitudinal slots 110, 112 defined therethrough. The respective rods 80, 82 fit into the respective inner steam chambers 108 of the rollers 100, 102. The longitudinal slots 110, 112 in the respective cylindrical body members 104, 106 function as steam vents that permit passage of steam from the rods 80, 82 radially outward through the cylindrical body members 104, 106 to a porous outer covering 114, 116 of the respective rollers 100, 102 surrounding the body members 104, 106 thereof. Each of the respective rollers 100, 102 also includes an annular rim 118, 120 rotatably mounted on one of the opposite ends of the cylindrical body member 104, 106 and an elongated clip 122, 124 pivotally attached at one end by a pin 126 extending between a pair of tabs 128 fixed to and extending outwardly from the rotatable annular rims 118, 120. A coiled spring 130 encircles the pin 126 and biases the clip 122, 124 to pivotally move from an opened position, as seen in FIG. 33, to a closed position, as seen in FIGS. 32 and 35, relative to the cylindrical body member 104, 106 of the respective roller 100, 102. The rotation of the annular rim 118, 120 of the respective roller 100, 102 relative to the body member 104, 106 thereof permits the clip 122, 124 to be positioned at any desired location about the body member 104, 106 after user's hair has been wrapped about the body member 104, 106. Finally, an elastic string or band 132 is attached to an opposite annular rim 134 fixed on the opposite end of the body member 104 and is stretchible to encompass the body member 104 and pass adjacent to at least one pin 136 fixed on and projecting outwardly from the rotatable annular rim 118 on the body member 104. The elastic band 132 provides means for anchoring the roller to the hair curled thereon.

Figure 38:
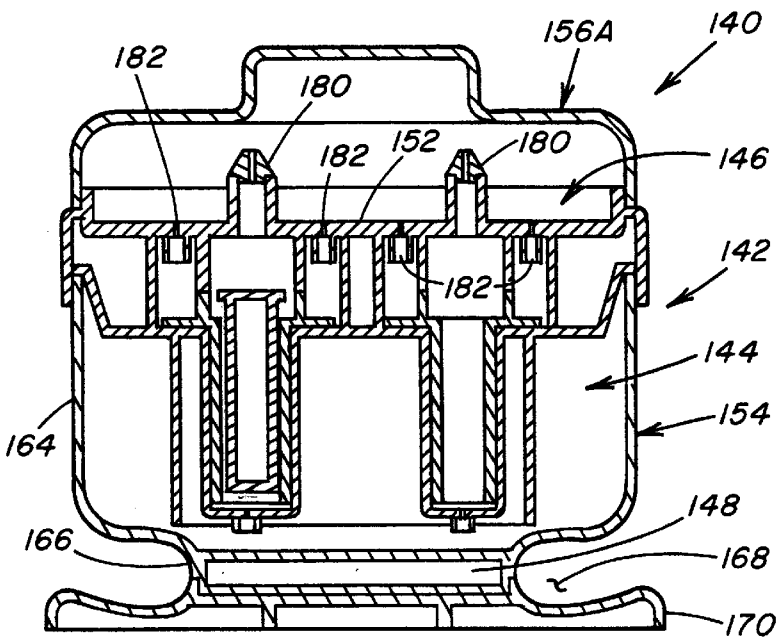
FIG. 38 is a side elevational view of the second embodiment of the roller heating apparatus with a different top cover than shown in FIG. 37.
Figure 37:
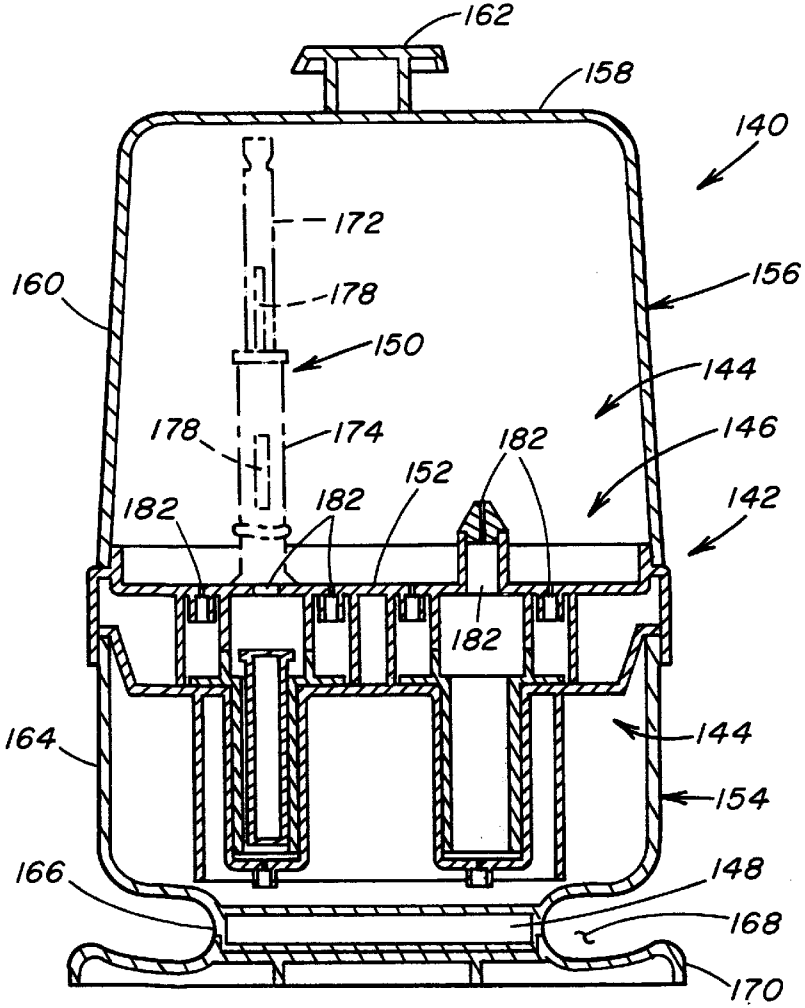
FIG. 37 is a side elevational view of a second embodiment of a multiple hair setting roller heating apparatus comprising the present invention.
Figure 39:
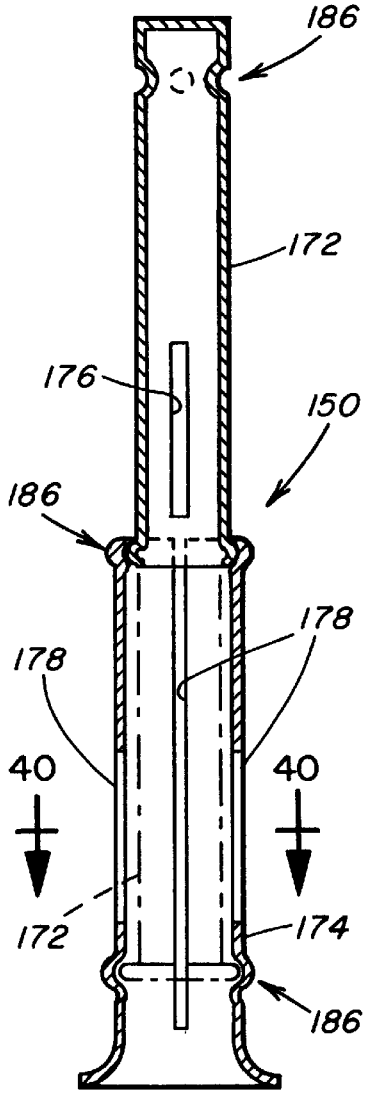
FIG. 39 is a vertical cross-sectional view of a first form of height-adjustable roller holder members of the roller heating apparatus of FIG. 37 wherein the upper roller support rods of the holder members telescopically insert into lower roller support rods thereof.

Referring now to FIGS. 37 and 38, there is illustrated a second embodiment of the multiple hair setting roller heating apparatus, generally designated 140, which comprises the present invention and is constructed also for heating the hair setting rollers for use in curling hair. Basically, the roller heating apparatus 140 includes a housing 142 defining a heating chamber 144, a roller support assembly 146 disposed in the heating chamber 144 of the housing 142 for holding hair setting rollers therein, and a heat generating source 148 disposed in the housing 142 for generating heat in order to raise the temperature of the hair setting rollers (not shown) when supported in the heating chamber 144 on the roller support assembly 146. Referring also to FIG. 39, the roller support assembly 146 includes a plurality of height-adjustable elongated holder members 150 (only a representative one being shown) disposed upright in the heating chamber 144 of the housing 142 and a platform 152 disposed in the housing 142 across the heating chamber 144 which supports the elongated holder members 150 upright in the housing 142. As will be described below, the height-adjustable holder members 150 are constructed of relatively movable parts having different diameter sizes permitting adjustable movement of the holder members 150 between lowered and raised positions, as respectively shown in dashed and solid line forms in FIG. 39 and in solid and dashed line forms in FIG. 42, for receiving and holding different numbers and sizes of hair setting rollers in the heating chamber 144 so as to thereby facilitate changing the roller holding capacity of the heating chamber 144 anywhere between maximum and minimum quantities of rollers. Generally speaking, the roller heating apparatus 140 of the second embodiment is similar to the previously-described roller heating apparatus 10 of the first embodiment except that the housing 142 of the second embodiment does not have portions which telescope relative to one another to change the height of the housing 142 and thus the size of the heating chamber 144. Only the roller holder members 150 in the second embodiment of the roller heating apparatus 140 are height-adjustable.

Referring to FIGS. 37 and 38, the housing 142 of the roller heating apparatus 140 includes an enclosure 154 which is adapted to receive and hold a quantity of fluid, such as water, and a top cover 156 removably fitted over the open top of the enclosure 154 for therewith defining and enclosing the heating chamber 144 of the housing 142. The top cover 156 shown in FIG. 37 is adapted to accommodate the presence of the roller holder members 150 in both their raised and lowered positions, whereas an alternative top cover 156A shown in FIG. 38 is provided for closing the open top of the enclosure 154 during periods of non-use when the roller holder members 150 are removed. The top cover 156 of FIG. 37 has a generally flat top panel 158, a continuous peripheral sidewall 160 attached to and surrounding the top panel 158 and extending downwardly therefrom, and a knob 162 attached to the exterior surface of the top panel 158. The enclosure 154 of the housing 142 includes an upper annular sidewall 164 defining its open top and a lower base 166 having a lower annular sidewall 168 disposed below and attached to the upper annular sidewall 164. The lower annular sidewall 168 has a diameter less than a diameter of the upper annular sidewall 164 so as to define an annular recessed region, the same as in the first embodiment of the apparatus 10, within which is stored an electrical cord in a wrapped relation about the lower annular sidewall 168 and extending through lower base 166 to connect with the the heat generating source disposed in the housing 142. The electrical cord and heat generating source are shown in the apparatus 10 of FIG. 2 but not in the apparatus 140 of FIGS. 37 and 38. The lower annular sidewall 168 of the lower base 166 also has an open bottom to which is attached a bottom cover 170 of the lower base.

Figure 40:
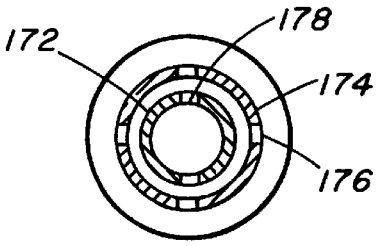
FIG. 40 is a transverse cross-sectional view taken along line 40—40 of FIG. 39.

Referring to FIGS. 37, 39 and 40, the height-adjustable roller holder members 150, more particularly, include a first plurality of upper elongated support posts or rods 172 disposed generally upright in the heating chamber 144 and adapted to receive a first group of hair setting rollers thereover and a second plurality of lower support posts or rods 174 slidably fitted telescopically with the upper support rods 172. The upper support rods 172 are thereby mounted to undergo telescopic sliding movement relative to the lower support rods 174 between the lowered and raised positions. The second support rods 174 are adapted to receive a second group of hair setting rollers thereover. More particularly, the upper and lower support rods 172, 174 are elongated hollow tubes. The tubes of the lower support rods 174 have opposite open upper and lower ends, whereas the tubes of the upper support rods 172 have closed upper ends and open lower ends. Both tubes of the upper and lower support rods 172, 174 have longitudinal slots 176, 178 defined therein permitting passage therethrough to the hair setting rollers of rising vapor, or steam, generated by heating the fluid, or water, in the housing 142. The platform 152 in the housing 142 has a plurality of upstanding projections 180 formed thereon and extending upwardly each for receiving and supporting, by frictional fits therebetween, respective ones of the lower support rods 174 thereover. The platform 152 also has a plurality of passages 182 defined therethrough which permit flow of vapor through the platform 152 into the interiors of the rods 172, 174 of the roller holder members 150 which extend thereabove and into the portions of the heating chamber 144 surrounding the exteriors of the roller holder members 150.

Figure 41:
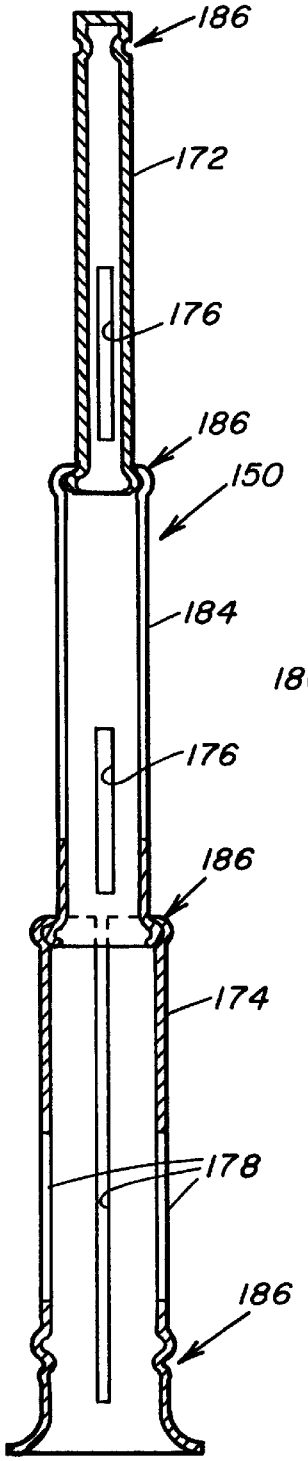
FIG. 41 is a vertical cross-sectional view of a second form of the height-adjustable roller holder members which can be provided in the roller heating apparatuses of FIGS. 2 and 37 wherein the holder members have telescoping lower, middle and upper roller support rods.
Figure 42:
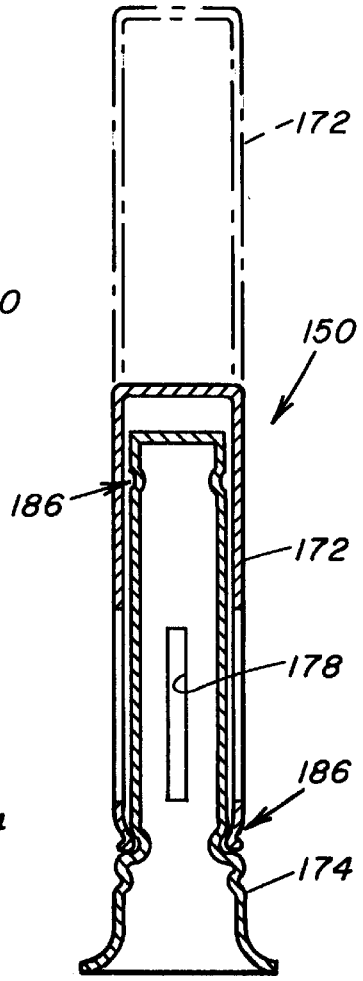
FIG. 42 is a vertical cross-sectional view of a third form of the height-adjustable roller holder members which can be provided in the roller heating apparatuses of FIGS. 2 and 37 wherein the lower roller support rods of the holder members telescopically insert into the upper roller support rods thereof.

FIGS. 39–42 illustrate different forms which the height-adjustable roller holder members 144 can take. Referring first to FIGS. 39 and 40, the upper rods 172 are smaller in diameter than the lower rods 174 such that the upper rods 172 insert telescopically into the lower rods 174 through the upper open ends thereof. In FIG. 41 where a middle rod 184 as well as upper and lower rods 172, 174 are provided, the diameter of the upper rod 172 is smaller than the middle rod 184, and the diameter of the middle rod 184, in turn, is smaller than the diameter of the lower rod 174 permitting insertion of the upper rod 172 into the middle rod 184 and insertion of the middle rod 184 into the lower rod 174 for providing relative telescoping movement between the upper, middle and lower rods. Conversely, as shown in FIG. 42, the lower rod 174 can be provided to have a diameter smaller than the upper rod 172 such that the lower rod 174 inserts telescopically into the upper rod 172 through the lower open end thereof. Respective portions of the upper, middle and lower rods 172, 184, 174 are deformably curled at 186 into complementary ribs and recesses being releasably matable so as to hold the roller holder members 150 at the respective raised and lowered positions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An apparatus for heating multiple hair setting rollers, said apparatus comprising:

(a) a housing defining a heating chamber;

(b) a plurality of height-adjustable elongated holder members supported upright in said heating chamber of said housing, each of said holder members being individually adjustably movable between a lowered position in which said holder member can engage and hold a first hair setting roller at a first elevation and a raised position in which said holder member can engage and hold a second hair setting roller at a second elevation above and in an end-to-end relationship with the first roller as the first roller is engaged and held at the first elevation to thereby facilitate changing the roller holding capacity of said heating chamber; and (c) means disposed in said housing for generating heat to raise the temperature of the hair setting rollers supported in said heating chamber on said holder members.

2. The apparatus of claim 1 wherein said height-adjustable roller holder members include:

a first plurality of elongated support rods disposed generally upright in said heating chamber and being adapted to receive a first group of hair setting rollers thereover; and a second plurality of support rods being slidably fitted telescopically with said first rods and thereby mounted to undergo telescopic sliding movement between said lowered and raised positions relative to said first rods, said second rods being adapted to receive a second group of hair setting rollers thereover.

3. The apparatus of claim 2 wherein said second rods are smaller in diameter than said first rods such that said second rods insert telescopically into said first rods through upper open ends thereof.

4. The apparatus of claim 2 wherein said first rods are smaller in diameter than said second rods such that said first rods insert telescopically into said second rods through lower open ends thereof.

5. The apparatus of claim 1 wherein said housing includes:

an enclosure having an open top; and a top cover removably fitted over said open top of said enclosure for enclosing said heating chamber and hair setting rollers supported on said holder members in said heating chamber.

6. The apparatus of claim 5 wherein said housing also includes a platform disposed in said enclosure across said heating chamber thereof and supporting said height-adjustable holder members in said heating chamber.

7. The apparatus of claim 5 wherein said top cover includes:

a generally flat top panel;

a peripheral sidewall attached to and surrounding said top panel and extending downwardly therefrom; and a knob attached to an exterior surface of said top panel.

8. The apparatus of claim 5 wherein said enclosure includes:

an upper annular sidewall defining said open top; and a lower base having a lower annular sidewall disposed below and attached to said upper annular sidewall.

9. The apparatus of claim 8 wherein said lower annular sidewall of said lower base has a diameter less than a diameter of said upper annular sidewall so as to define an annular recessed region surrounding said lower annular sidewall and underlying said upper annular sidewall within which is stored an electrical cord in a wrapped relation about said lower annular sidewall, said electrical cord extending through said lower base to connect with said heating means disposed in said housing.

10. The apparatus of claim 8 wherein:

said lower annular sidewall of said lower base has an open bottom; and said lower base also has a bottom cover attached to said open bottom of said lower annular sidewall.

11. The apparatus of claim 1 further comprising:

a plurality of first rollers; and a plurality of second rollers.

12. An apparatus for heating multiple hair setting rollers, said apparatus comprising:

(a) a housing having a heating chamber defined therein, said housing being adapted to hold a quantity of fluid;

(b) a plurality of height-adjustable elongated hollow holder members supported upright in said heating chamber of said housing, each of said holder members being individually adjustably movable between a lowered position in which said holder member can hold a first hair setting roller at a first elevation and a raised position in which said holder member can hold a second hair setting roller at a second elevation above and in an end-to-end relationship with the first roller held at the first elevation to thereby facilitate changing the roller holding capacity of said heating chamber, said holder members having opposite upper and lower ends and being open at said lower ends and having side openings therein defined between said opposite upper and lower ends; and (c) means disposed in said housing for generating heat therein that transforms the fluid into a rising vapor which enters said heating chamber through said holder members at said lower ends thereof such that the rising vapor passes internally through said holder members and exits from said holder members through said side openings thereof to the hair setting rollers so as to raise the temperature of the hair setting rollers supported in said heating chamber on said holder members.

13. The apparatus of claim 12 wherein said housing includes:

an enclosure having an open top; and a top cover removably fitted over said open top of said enclosure for enclosing said heating chamber and hair setting rollers supported on said holder members in said heating chamber.

14. The apparatus of claim 13 wherein said housing also includes a platform disposed in said enclosure across said heating chamber thereof and supporting said height-adjustable holder members in said heating chamber.

15. The apparatus of claim 12 wherein said height-adjustable roller holder members include:

a first plurality of elongated support rods disposed generally upright in said heating chamber and being adapted to receive a first group of hair setting rollers thereover; and a second plurality of support rods being slidably fitted telescopically with said first rods and thereby mounted to undergo telescopic sliding movement between said lowered and raised positions relative to said first rods, said second rods being adapted to receive a second group of hair setting rollers thereover.

16. The apparatus of claim 15 wherein said second rods are smaller in diameter than said first rods such that said second rods insert telescopically into said first rods through upper open ends thereof.

17. The apparatus of claim 15 wherein said first rods are smaller in diameter than said second rods such that said first rods insert telescopically into said second rods through lower open ends thereof.

18. The apparatus of claim 12 further comprising:

a plurality of first rollers; and a plurality of second rollers.

19. An apparatus for heating multiple hair setting rollers, said apparatus comprising:

(a) a housing including an enclosure adapted to hold a quantity of fluid and having an open top and a top cover removably fitted over said open top of said enclosure for defining therewith and enclosing a heating chamber in said housing;

(b) a roller support assembly disposed in said heating chamber of said housing for holding hair setting rollers therein, said roller support assembly including (i) a plurality of height-adjustable elongated holder members supported upright in said heating chamber of said housing, said height-adjustable holder members being individually adjustably movable between lowered and raised positions for holding different numbers and sizes of hair setting rollers in said heating chamber to thereby facilitate changing the roller holding capacity of said heating chamber, said roller holder members including a first plurality of elongated support rods disposed generally upright in said heating chamber and being adapted to receive and engage and hold a first group of hair setting rollers thereover at a first elevation and a second plurality of support rods being slidably fitted telescopically with said first rods and thereby mounted to undergo telescopic sliding movement between said lowered and raised positions relative to said first rods, said second rods in said raised positions relative to said first rods being adapted to receive and engage and hold a second group of hair setting rollers thereover at a second elevation such that each of the rollers in the second group thereof received over and engaged and held by said second rods is disposed above and in an end-to-end relationship with one of the rollers in the first group thereof as the rollers in the first group are received over and engaged and held by said first rods at the first elevation, and (ii) a platform disposed in said heating chamber of said housing and supporting said first plurality of support rods in said heating chamber; and (c) means disposed in said housing for generating heat therein to transform the fluid into a vapor which enters said heating chamber and said holder members of said first and second pluralities thereof such that the hair setting rollers supported in said heating chamber on said holder members are heated.

20. The apparatus of claim 19 wherein said first and second rods of each of said height-adjustable holder members are elongated hollow tubes, said first rods having opposite open upper and lower ends, said second rods having closed upper ends and open lower ends, said first and second rods having longitudinal slots defined therein extending between said opposite upper and lower ends, said longitudinal slots and said opposite open upper and lower ends of said first rods and open lower ends of said second rods permitting passage therethrough to the hair setting rollers of rising vapor generated by heating the fluid in said housing.

21. The apparatus of claim 19 whererin said second rods are smaller in diameter than said first rods such that said second rods insert telescopically into said second rods through lower open ends thereof.

22. The apparatus of claim 19 wherein said first rods are smaller in diameter than said second rods such that said first rods insert telescopically into said second rods through lower open ends thereof.

23. The apparatus of claim 19 further comprising:

a first group of hair setting rollers; and a second group of hair setting rollers.

* * * * *